US007931171B2

(12) United States Patent
Hamamura et al.

(10) Patent No.: US 7,931,171 B2
(45) Date of Patent: Apr. 26, 2011

(54) PAINT CARTRIDGE

(75) Inventors: Takehiro Hamamura, Fujieda (JP); Toshio Onda, Edogawa-ku (JP)

(73) Assignee: ABB K.K., Tokyo (JP)

( * ) Notice: Subject to any disclaimer, the term of this patent is extended or adjusted under 35 U.S.C. 154(b) by 170 days.

(21) Appl. No.: 12/299,478

(22) PCT Filed: Oct. 5, 2007

(86) PCT No.: PCT/JP2007/070018

§ 371 (c)(1),
(2), (4) Date: Nov. 4, 2008

(87) PCT Pub. No.: WO2008/068957

PCT Pub. Date: Jun. 12, 2008

(65) Prior Publication Data

US 2009/0206177 A1 Aug. 20, 2009

(30) Foreign Application Priority Data

Dec. 4, 2006 (JP) ..... 2006-327060

(51) Int. Cl.
*B65D 35/28* (2006.01)

(52) U.S. Cl. ..... 222/95; 222/105; 222/386.5; 222/389; 239/323

(58) Field of Classification Search ..... 222/95, 222/105, 325, 386.5, 389, 464.2; 239/322, 239/323
See application file for complete search history.

(56) References Cited

U.S. PATENT DOCUMENTS

| | | | | |
|---|---|---|---|---|
| 3,270,920 | A * | 9/1966 | Nessler | 222/95 |
| 4,809,884 | A * | 3/1989 | Stackhouse | 222/153.04 |
| 4,889,189 | A * | 12/1989 | Roznieck | 169/73 |
| 5,529,214 | A * | 6/1996 | Lasonde et al. | 222/105 |
| 6,164,561 | A | 12/2000 | Yoshida et al. | |
| 6,533,861 | B1 * | 3/2003 | Matsuda et al. | 118/323 |
| 7,014,713 | B2 * | 3/2006 | Nakane | 118/300 |
| 7,156,045 | B2 * | 1/2007 | Ueno et al. | 118/50.1 |
| 7,588,196 | B2 * | 9/2009 | Kubota et al. | 239/223 |
| 2005/0189435 | A1 | 9/2005 | Kubota et al. | |
| 2008/0202413 | A1 * | 8/2008 | Seitz et al. | 118/300 |

FOREIGN PATENT DOCUMENTS

| | | |
|---|---|---|
| JP | 8 229446 | 9/1996 |
| JP | 9 41 | 1/1997 |
| JP | 11 262699 | 9/1999 |
| JP | 2005 230718 | 9/2005 |
| JP | 2006 187732 | 7/2006 |

* cited by examiner

*Primary Examiner* — Kenneth Bomberg
*Assistant Examiner* — Daniel R Shearer
(74) *Attorney, Agent, or Firm* — Oblon, Spivak, McClelland, Maier & Neustadt, L.L.P.

(57) ABSTRACT

A tank base (12) is formed of a mount block (13) and a feed tube (16), and a first paint passage (17) is provided internally through the feed tube (16). A baggy tank (19) is composed of a support member (20) and a bag member (21) having opposite ends thereof securely fixed to the support member (20) to define a paint chamber (22) therein. A second paint passage (23) is provided in a fore end portion (20A) of the support member (20). A tank accommodating case (25) is provided to accommodate the bag member (21). The baggy tank (19) is set in position within the tank accommodating case (25) with opposite ends of the support member (20) gripped between the mount block (13) of the tank base (12) and the tank accommodating case (25), bringing the paint chamber (22) into communication with the first paint passage (17) through the second paint passage (23).

9 Claims, 10 Drawing Sheets

PAINT CARTRIDGE

TECHNICAL FIELD

This invention relates to a paint cartridge to be replaceably attached, for example, to a coater unit for paint supply.

BACKGROUND ART

Generally, paint coating systems in use for painting vehicle bodies or the like are required to cope with paint color changes among a large number of paint colors, discarding a less amount of paint at the time of each color change. As a paint coating system which can meet these requirements, there has been known a cartridge type paint coating system employing a number of interchangeable paint cartridges which are filled with different paint colors (e.g., Patent Literature 1: Japanese Patent Laid-Open No. H11-262699).

Paint cartridges which are employed in the above-mentioned paint coating system are each largely constituted by a hollow cartridge body in the form of a cylindrical tank adapted to be replaceably set on a coater unit, a feed tube axially projected forward from a front end of the cartridge body, a piston axially slidably fitted in the tank of the cartridge body through a circumferential seal member to define a paint chamber and an extruding liquid chamber on the opposite sides thereof, a paint passage formed axially in the above-mentioned feed tube and communicated with the paint chamber, and an extruding liquid passage adapted to supply an extruding liquid to and from the extruding liquid chamber in the body tank.

On the other hand, in the case of the paint cartridges in Patent Literature 1 above, a bellows structure is also adopted in place of a piston to serve as a movable partition wall dividing a cartridge tank into a paint chamber and an extruding liquid chamber.

Further, there have been known paint cartridges incorporating a balloon into a cartridge tank instead of a piston or a bellows as described above (e.g., Patent Literature 2: Japanese Patent Laid-Open No. H8-229446). In another case, a stretchable baggy membrane is provided in a tank (e.g., Patent Literature 3: Japanese Utility Model Laid-Open No. H9-41).

Of the paint cartridges mentioned above, the paint cartridge of Patent Literature 1 is arranged to spurt paint into a coater unit from a paint chamber by supplying an extruding liquid to an extruding liquid chamber to displace a piston or a bellows in a paint extruding direction.

Further, in the case of Patent Literature 2, paint in a cartridge tank is spurted out toward a coater unit by inflating a balloon which is connected to an air supply source. In Patent Literature 3, paint in a baggy membrane is pushed and spurted out toward a coater unit by introduction of an operating fluid.

Further, known in the art is a paint cartridge which has an extruding liquid chamber defined within a cylindrical tank body by a partitioning membrane unit which is attached to a base frame structure, and a paint chamber defined between the tank and the partitioning membrane unit. In this case, paint in the paint chamber is spurted out toward a coater unit by supplying an extruding liquid into the partitioning membrane unit (e.g., Patent Literature 4: Japanese Patent Laid-Open No. 2006-187732).

Furthermore, known in the art is still another paint cartridge which is composed of a paint storage unit adapted to store paint internally of a flexible tube, and a holder casing adapted to hold the paint storage unit thereon. The holder casing of the paint cartridge is loaded into a cartridge compartment which is provided on the side of a coater unit. In the case of this paint cartridge, a liquid-tight space is defined between the cartridge compartment and the holder casing to form an extruding liquid chamber around the paint storage unit. Paint in the paint storage unit is spurted out toward a coater unit by pressing the flexible paint container tube of the paint storage unit with an extruding liquid which is supplied to the extruding liquid chamber (e.g., Patent Literature 5: Japanese Patent Laid-Open No. 2005-230718).

In the case of the paint cartridge of Patent Literature 1 mentioned above, a piston is provided within a body tank. That is to say, the inner surfaces of the body tank of the paint cartridge, which are held in sliding engagement with a piston, need to be machined and finished with high dimensional accuracy and to a high degree of smoothness, in addition to a necessity for periodical replacements of a seal member or members to maintain a liquid-tight seal, despite increases in initial cost and in running cost.

Besides, when a piston (a seal member) is put in a sliding movement within the body tank of the paint cartridge, paint in the paint chamber leaks into the extruding liquid chamber little by little to impair electrical insulating properties of the extruding liquid. Therefore, it becomes necessary to replace the extruding liquid on a periodical basis, which will invite further increases in running cost.

On the other hand, a paint cartridges incorporating a bellows as in Patent Literature 1, a balloon as in Patent Literature 2, a stretchable membrane as in Patent Literature 3 or a partition membrane as in Patent Literature 4 is invariably subjected to expansile and contractile loads repeatedly at the time of expansion and contraction, and therefore vulnerable to damages when inflated with a large amount of paint or to damages as caused by ageing deteriorations, necessitating a replacement relatively at a high frequency. This gives rise to another problem that it is very difficult and time-consuming to replace a bellows, balloon, stretchable membrane or partitioning membrane, which is integrally attached to a tank or a base frame. Besides, since a bellows, balloon, stretchable membrane or partition membrane is invisibly accommodated within a body tank of a paint cartridge, it is almost impossible to spot a defect in these parts until it comes out as a serious coating failure.

Further, in the case of the paint cartridge of Patent Literature 5, it is necessary to replace the paint storage unit by a fresh replenished unit every time before starting a painting operation. That is to say, it takes a longer time in preparing for a painting operation. Further, in the case of the paint cartridge of Patent Literature 5, an extruding liquid chamber is defined through utilization of inner wall surfaces of a cartridge compartment within a housing of the coater unit. Therefore, in case the flexible tube of the paint storage unit is ruptured, paint flows out and deposits on inner wall surfaces of the housing which serve as the cartridge compartment, rendering the coater unit inoperative until the housing is washed clean.

DISCLOSURE OF THE INVENTION

In view of the problems with the prior art, it is an object of the present invention to provide a paint cartridge employing a baggy tank which is simplified in construction and which can attached to or detached from a tank base in a facilitated manner at the time of replacement.

(1) According to the present invention, there is provided a paint cartridge, comprising: a tank base composed of a mount block to be mounted on a coating means, and a feed tube extended forward on front side of the mount block; a first paint passage formed internally of the tank base through the feed tube; a baggy tank composed of a support member extended in forward and rearward directions, and a bag member formed of a flexible material and wrapped around the support member, the bag member having opposite ends thereof fixed liquid tight to the support member to define a paint chamber in said bag member; a second paint passage formed internally of the support member of the baggy tank with a rear end thereof opened to the paint chamber, a fore end of the second paint passage being brought into communication with the first paint passage when the baggy tank is attached to the tank base; a tank accommodating case in the form of a lidded tubular case having an open end portion on front side and being closed with a lid portion on rear side, the open end portion being detachably attached to the mount block in such a way as to grip opposite ends of the support member of the baggy tank between the mount block of the tank base and the lid portion; an extruding liquid chamber defined between the baggy tank and the tank accommodating case when the baggy tank is placed in the tank accommodating case after attaching the latter to the mount block of the tank base; and an extruding liquid passage provided on the tank base to supply an extruding liquid to and from the extruding liquid chamber.

With the arrangements just described, a fore end portion of the support member of the baggy tank is attached to the mount block of the tank base to bring the second paint passage into communication with the first paint passage on the tank base. An open end portion of the tank accommodating case is fixed to the mount block to accommodate the baggy tank therein. At this time, a rear end portion of the support member of the baggy tank is fitted in the lid portion of the tank accommodating case, fixedly gripping the support member of the baggy tank between the mount block of the tank base and the lid portion of the tank accommodating case. Whereupon, an extruding liquid chamber is defined between the bag member of the baggy tank and the tank accommodating case, in communication with an extruding liquid passage which supplies an extruding liquid to and from the extruding liquid chamber.

At the time of a paint coating operation, the paint cartridge which filled with a predetermined amount of paint in the paint chamber in the bag member of the baggy tank is set on a coating means. In this state, an extruding liquid is supplied to the extruding liquid chamber through the extruding liquid passage thereby to push the bag member from outside. As a result, paint in the paint chamber is spurted out from a fore end of the feed tube through the second paint passage in the support member and the first paint passage in the tank base.

On the other hand, at the time of paint replenishment, an emptied paint cartridge is set on a paint replenishing unit, and in this state paint can be replenished into the paint chamber in the bag member from a fore end of the feed tube via the respective paint passages.

Then, at the time of replacement of the baggy tank, the baggy tank can be dismantled and replaced by a new one easily in a short time period by detaching the tank accommodating case from the mount block of the tank base.

As a result, the baggy tank to be replaced is simply composed of a support member and a bag member and very simplified in construction to such a degree as to permit suppression of its production cost as well as reductions in initial cost and running cost. In addition, the baggy tank can be replaced simply by detaching the tank accommodating case from the mount block of the tank base, without using any tool, permitting to perform a replacing job efficiently in facilitated manner. Different from a barrel in which a piston is put in sliding movements, the tank accommodating case which is intended for accommodation of a baggy tank can be fabricated easily by injection molding, for example, without requiring accurate machining operations in a finishing stage.

(2) Further, according to the present invention, the paint chamber of the baggy tank is arranged to have a larger inner volume as compared with that of the tank accommodating case attached to the tank base.

Thus, in case paint is overcharged into the paint chamber, the bag member is brought into abutting contact with inner surfaces of the tank base and tank accommodating case before it is attacked by overcharging loads, for prolonging the service life of the baggy tank. Since the bag member is kept free of overcharging loads, it can be produced at a low cost by the use of a material which is available in general.

(3) Further, according to the present invention, the tank accommodating case is formed of a transparent or semi-transparent synthetic resin material.

Thus, at the time of inspection and service, the baggy tank is visible through the transparent or semi-transparent tank accommodating case and can be easily checked from outside by eye inspection. In the event of breakage of the bag member of the baggy tank, it can be spotted from outside by eye inspection in an early stage to suppress losses to a minimum.

(4) Further, according to the present invention, the bag member of the baggy tank is a dual bag structure composed of an inner bag and an outer bag intervened by a gap space, and a leakage liquid discharge passage is formed in the support member of the baggy tank to communicate the gap space with the outside through the lid portion of the tank accommodating case.

Thus, in the event of breakage of the inner bag, paint which has leaked from the inner bag is discharged to the outside from the gap space between the inner and outer bags through the leakage liquid discharge passage which is provided in the support member to communicate with the outer atmosphere, as a sign of breakage of the inner bag letting an operator spot the inner bag breakage in an early stage. On the other hand, in the event of breakage of the outer bag, the extruding liquid which has leaked from the outer bag is discharged to the outside from the gap space between the inner and outer bags through the leakage liquid discharge passage, as a sign of breakage of the outer bag letting an operator spot the outer bag breakage in an early stage.

(5) Further, according to the invention a communication passage is formed in the lid portion of the tank accommodating case to communicate the leakage liquid discharge passage with the outside.

Thus, in the event of breakage of the inner or outer bag, paint or extruding liquid can be urged to flow into the leakage liquid discharge passage and discharged to the outside through the communication passage in the lid portion.

(6) On the other hand, according to the invention, the extruding liquid passage is opened in a bottom surface of the mount block of the tank base, and an extruding liquid guide groove is formed into the bottom surface in communication with the extruding liquid passage.

With the arrangements just described, the extruding liquid passage is constantly communicated with the extruding liquid chamber by the extruding liquid guide groove because there is little possibility of the extruding liquid passage being covered by the bag member, thus precluding paint replenishment failures to guarantee improved operational reliability.

(7) Further, according to the invention, the tank accommodating case is constituted by a cylindrical cover with the open end portion on front side and a lid detachable opening on rear side, and a lid portion detachably fitted to cover the bottom opening of the cylindrical cover.

Thus, in the event of breakage of the bag member of the baggy tank, the bag member can be easily taken out of the tank accommodating case through the lid detachable opening by removing the lid portion to uncover the lid detachable opening of the cylindrical cover.

(8) Further, according to the invention, the tank accommodating case is formed in the shape of a single lidded tubular case having the open end portion at a fore end and a closed bottom at a rear end thereof.

Thus, attachment and detachment of the tank accommodating case to and from the tank base can be facilitated to a considerable degree by adoption of a tank accommodating case in the form of a single lidded tubular case.

(9) Further, according to the invention, the tank accommodating case is fixedly fastened to the mount block of the tank base by threading a retainer ring which is in engagement with outer periphery of the open end portion of the tank accommodating case and screwed with the mount block of the tank base.

Thus, the tank accommodating case can be attached to or detached from the mount block of the tank base in a facilitated manner simply by turning a retainer ring with hands, without using any sort of tool in particular.

(10) Further, according to the present invention, there is also provided a paint cartridge, comprising: a tank base integrally formed of a mount block to be mounted on a coating means, a tank accommodating case extended rearward from the mount block, and a feed tube extended forward on a front side of the mount block; a first paint passage formed internally of the tank base through the feed tube; a baggy tank composed of a support member extended in forward and rearward directions and a bag member formed of a flexible material and wrapped around the support member, the bag member having opposite ends thereof fixed liquid tight to the support member to define a paint chamber therein; a second paint passage formed internally of the support member of the baggy tank with a rear end thereof opened to the paint chamber, a fore end of the second paint passage being brought into communication with the first paint passage when the baggy tank is attached to the tank base; a lid member detachably attached to a rear end of the tank accommodating case of the tank base and adapted to grip opposite ends of the support member of the baggy tank in cooperation with the mount block of the tank base; an extruding liquid chamber defined between the baggy tank and the tank accommodating case when the baggy tank is placed in the tank accommodating case after attaching the lid member to the tank accommodating case; and an extruding liquid passage provided on the tank base to supply an extruding liquid to and from the extruding liquid chamber.

With the arrangements just described above, the baggy tank is placed in the tank accommodating case by fitting a fore end portion of the support member of the baggy tank to the mount block of the tank base, bringing the second paint passage into communication with the first paint passage of the tank base. Then, the rear end of the tank accommodating case is closed with the lid member which is adapted to grip the support member of the baggy tank in cooperation with the mount block of the tank base and the lid member. Upon closing the rear end of the tank accommodating case, an extruding liquid chamber is defined between the bag member of the baggy tank and the tank accommodating case, and the extruding liquid chamber is communicated with an extruding liquid passage which supplies an extruding liquid to and from the extruding liquid chamber.

On the other hand, at the time of replacing the baggy tank, after removing the lid member and dismantling a damaged baggy tank out of the tank accommodating case, a fresh baggy tank can be set in position easily within a short period of time.

BEST MODE FOR CARRYING OUT THE INVENTION

Hereafter, with reference to the accompanying drawings, the paint cartridge according to an embodiment of the invention is described more particularly by way of its preferred embodiments which are applied to a rotary atomizing head type coating apparatus.

Figure 1:
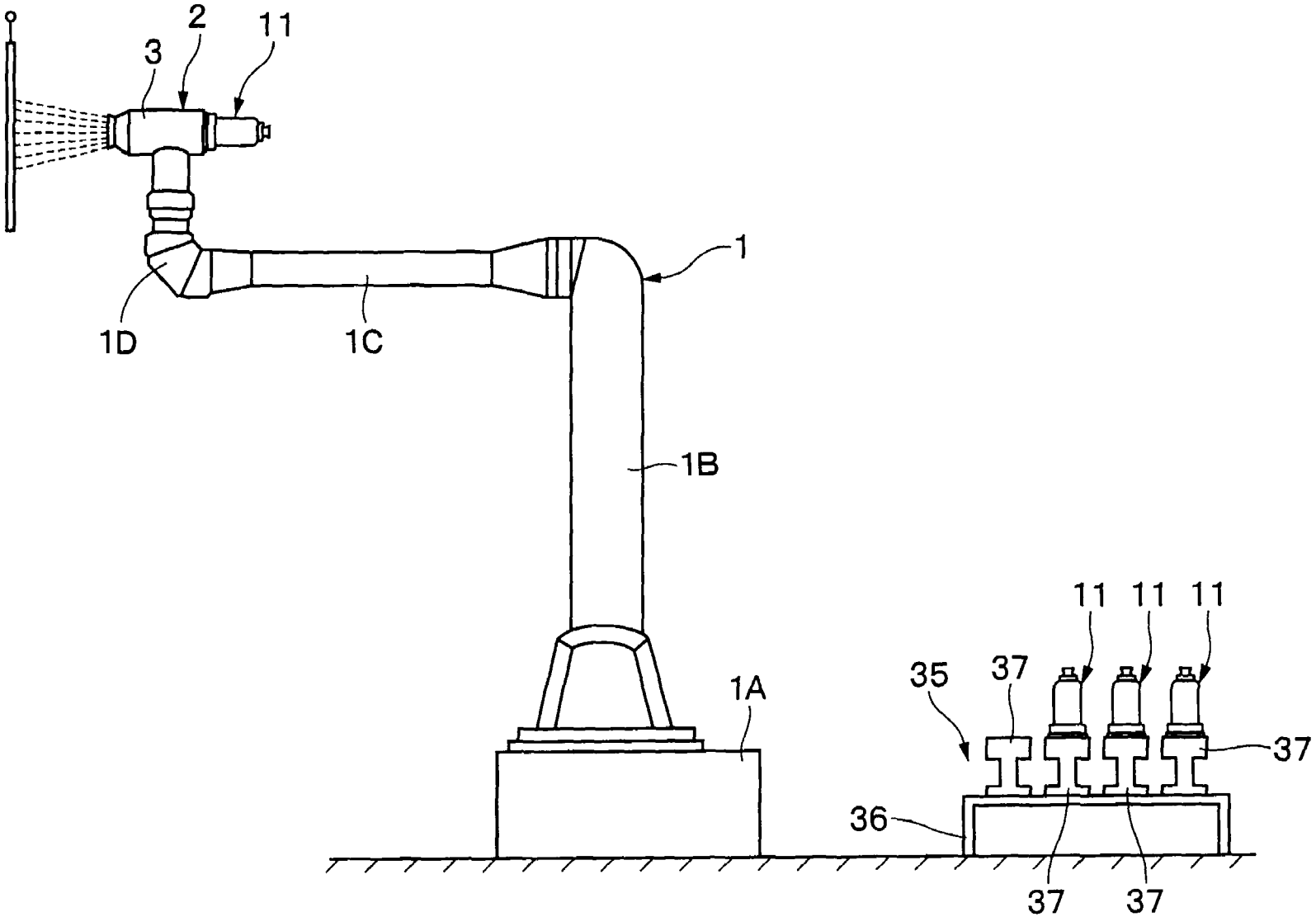
FIG. 1 is a schematic view of a paint coating system adopting paint cartridges according to a first embodiment of the invention.

Referring first to FIGS. 1 through 8, there is shown a first embodiment of the invention. In FIG. 1, indicated at 1 is a coating robot which forms a part of a paint coating system. This coating robot 1 is largely constituted of a mounting base 1A, a vertical arm 1B which is rotatably and pivotally mounted on the mounting base 1A, a horizontal arm 1C which is pivotally supported on a distal end of the vertical arm 1B, and a wrist 1D which is connected at a distal end of the horizontal arm 1C.

Figure 2:
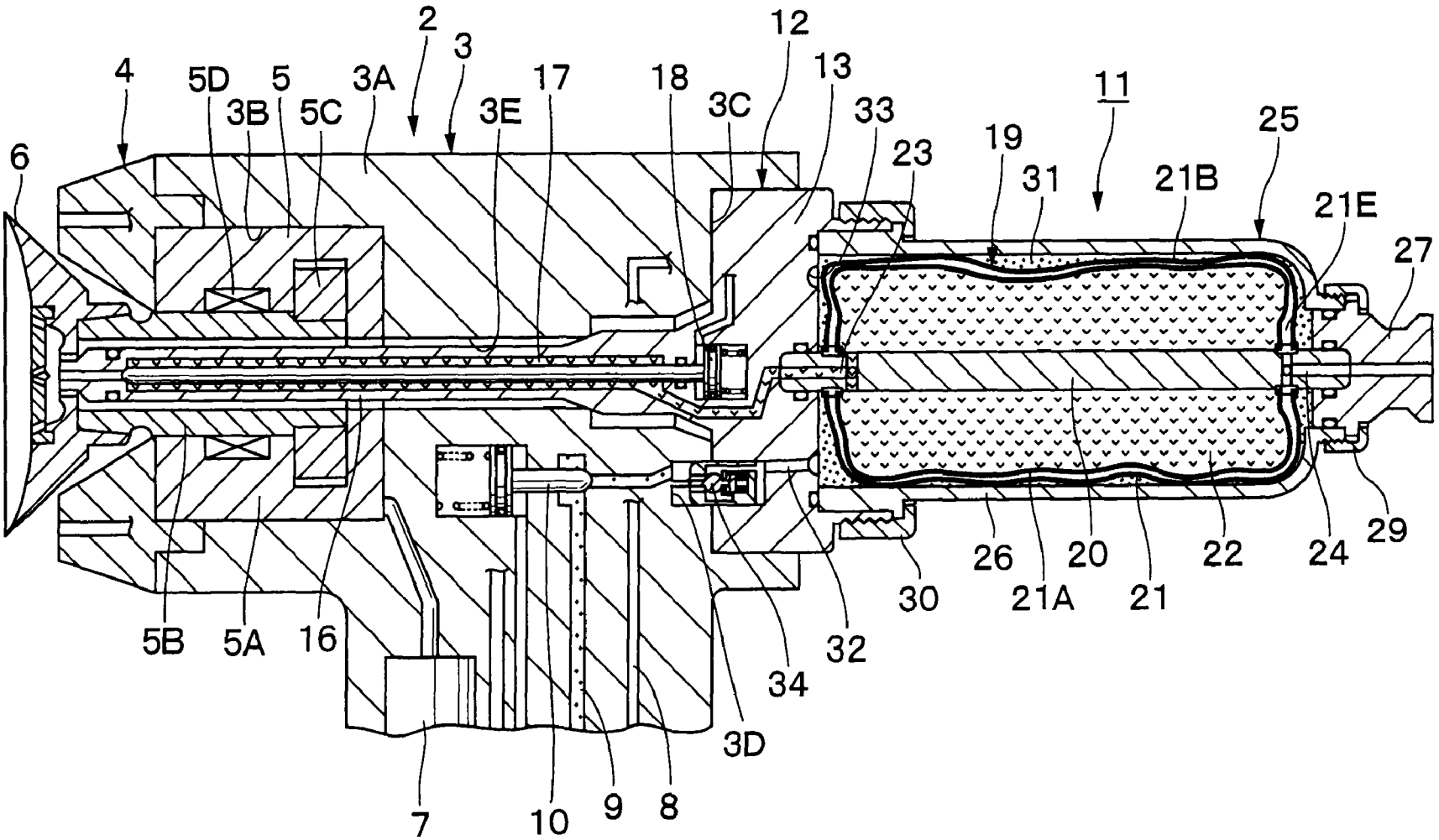
FIG. 2 is a longitudinal sectional view showing a rotary atomizing head type coating apparatus of FIG. 1 on an enlarged scale.

Indicated at 2 is a rotary atomizing head type coating apparatus mounted on the coating robot 1 (hereinafter referred to simply as "coating apparatus" which is operative as a coating means. As shown in FIG. 2, this coating apparatus 2 is largely constituted by a housing 3, a coater unit 4 and a paint cartridge 11, which will be described hereinafter.

Indicated at 3 is a housing which is attached to a distal end of the wrist 1D of the coating robot 1, and provided with a head housing section 3A on its front side. A coater unit mounting portion 3B and a cartridge mounting portion 3C, which are both in the form of a hollow cylindrical cavity, are provided in front and rear end portions of the head section 3A, respectively. Provided at the bottom of the cartridge mounting portion 3C is a female connector portion 3D to be connected with a quick joint 34 on the side of a paint cartridge 11, which will be described hereinafter.

Further, a feed tube passage hole 3E is extended axially and centrally of the head section 3A of the housing 3 to receive therein a feed tube 16 of the paint cartridge 11, which is extended axially forward through the coater unit mounting portion 3B and a rotational shaft 5B of an air motor 5 which will be described hereinafter.

Denoted at 4 is a coater unit which is mounted within the coater unit mounting portion 3B of the housing 3. This coater unit 4 is largely constituted by a motor case 5A, a rotational shaft 5B, an air motor 5 having an air turbine 5C and an air bearing 5D, and a rotary atomizing head 6 which is put in rotation by the air motor 5 to spray forward centrifugally divided fine particles of paint which is supplied from the feed tube 16.

Indicated at 7 is a high voltage generator which is provided within the housing 3. This high voltage generator 7 is constituted, for example, by a Cockcroft circuit which is adapted to elevate a voltage from a power supply (not shown) to a high voltage of −30 kV to −150 kV. On the output side, the high voltage generator 7 is electrically connected, for example, to the air motor 5 to apply a high voltage to the rotary atomizing head 6 through the rotational shaft 5B of the air motor 5 for directly charging paint.

Designated at 8 are a plural number of air passages provided in the housing 3 which are connected to a control air source (not shown). Supplied through these air passages 8 are turbine air, bearing air, and brake air for the control of the air motor 5, shaping air for the control of a paint spray pattern, and pilot air for driving an extruding liquid valve 10 and a paint valve 18.

Indicated at 9 is an extruding liquid passage on the side of the housing 3. This extruding liquid passage 9 is connected at one end to an extruding liquid source (not shown) and opened at the other end to a bottom portion of a female connector portion 3D which is formed in the cartridge mounting portion 3C on the housing 3.

Denoted at 10 is an extruding liquid valve which is provided in the head section 3A of the housing 3. Normally, this extruding liquid valve 10 is in a position to block an extruding liquid passage 9 to suspend an extruding liquid supply to the extruding liquid chamber 31 of the paint cartridge 11. On the other hand, upon supply of pilot air, the extruding liquid valve 10 is opened to supply an extruding liquid to the extruding liquid chamber 31.

Figure 3:
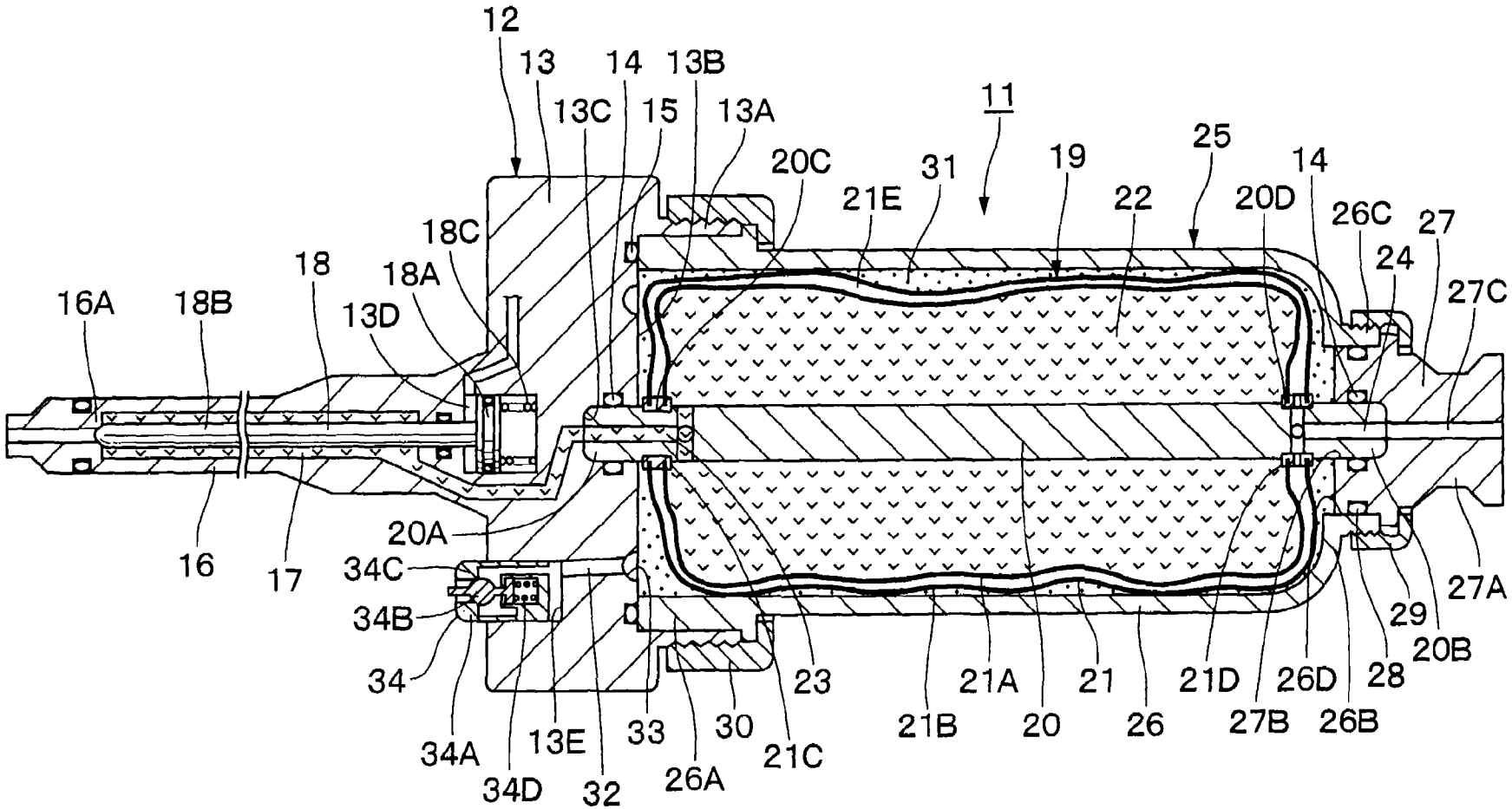
FIG. 3 is a longitudinal sectional view showing one of the paint cartridges according to the first embodiment of the invention on an enlarged scale.

Now, indicated at 11 is a paint cartridge which is detachably set in the cartridge mounting portion 3C on the housing 3. As shown in FIG. 1, a plural number of similar paint cartridges 11 are provided for the paint coating system, each paint cartridge 11 is detachably set on a paint replenishing deck 37 of a paint replenishing unit 35, which will be described hereinafter. The respective paint cartridges 11 are charged with and used exclusively for a plural number of different paint types (different paint colors). As shown in FIG. 3, each paint cartridge 11 is largely constituted by a tank base 12, a first paint passage 17, a baggy tank 19, a paint chamber 22, a second paint passage 23, a leakage liquid discharge passage 24, a tank accommodating case 25, an extruding liquid chamber 31, and an extruding liquid passage 32, which will be described hereinafter.

In this instance, the tank base 12, i.e., a base of the paint cartridge 11, is constructed in the manner as described below.

Namely, the tank base 12 is largely constituted by a mount block 13 formed in the shape of a short cylinder or a round disc, a feed tube 16 which is projected forward from a center portion of the mount block 13, a first paint passage 17 which is formed through the mount block 13 and the feed tube 16, and a paint valve 18 which is operative to open and close the first paint passage 17.

Figure 4:
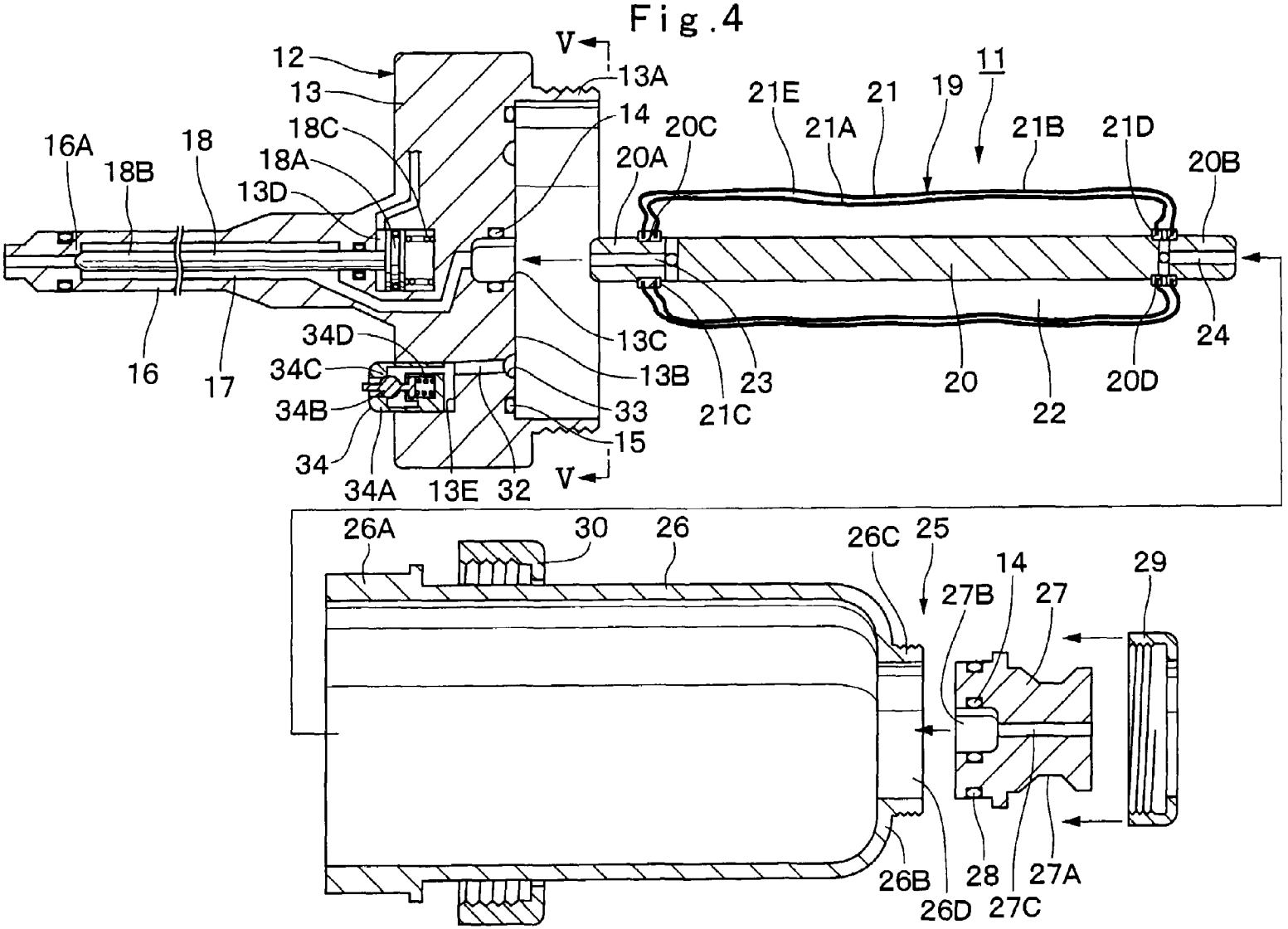
FIG. 4 is a longitudinal sectional view showing the paint cartridge of FIG. 3 in a disassembled state.
Figure 5:
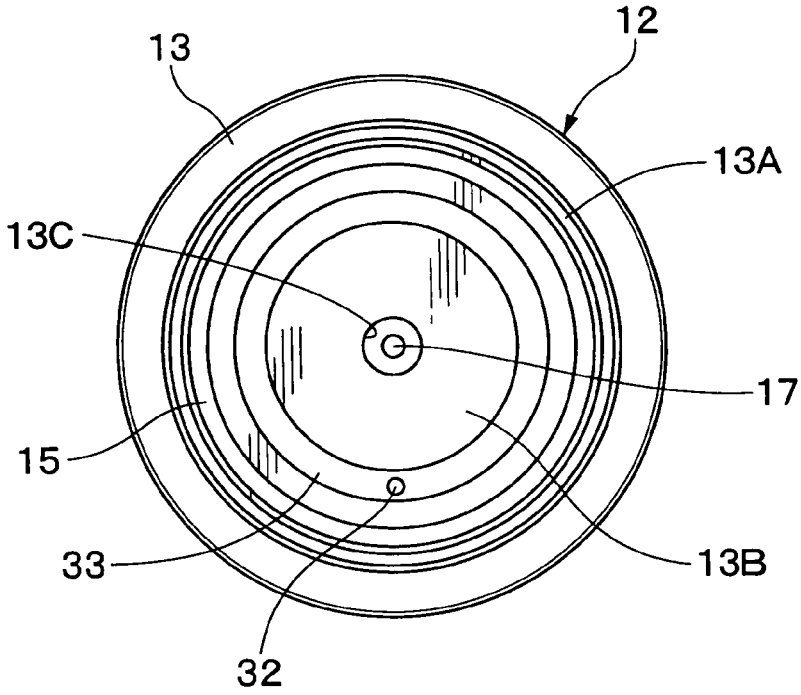
FIG. 5 is a right-hand side view taken in the direction of arrows V-V of FIG. 3, showing a bottom side of the mount block of the tank base.

The mount block 13 which constitutes a rear side portion of the tank base 12 is so shaped as to fit in the cartridge mounting portion 3C of the housing 3 and function as mount block of the coater unit 4. The mount block 13 is formed in the shape of a short cylinder or a round disc, and provided with an annular screwed projection 13A on the rear side. A male screw is tapped on and around the outer periphery of the annular screwed projection 13A, while a cylindrical space is defined on the inner peripheral side of the screwed projection 13A, and a support member fitting hole 13C is formed centrally into a bottom surface 13B to receive a fore end portion of a support member 20 of the baggy tank 19 as shown in FIGS. 4 and 5. Further, a seal member 14 is fitted in the support member fitting hole 13C to form a liquid-tight seal around the circumference of the support member 20 of the baggy tank 19. On the other hand, a seal member 15 is provided in a radially outer region of the bottom surface 13B to hermetically seal an extruding liquid chamber 31 by tight engagement with an open end portion 26A of a cylindrical cover 26, which will be described hereinafter.

Further, a valve member receptacle space 13D is formed centrally into the front side of the mount block 13 at a position on the front side of the support member fitting hole 13C to accommodate therein a paint valve 18, which will be described hereinafter. In addition, a joint installation cavity 13E is provided on the front side of the mount block 13 to accommodate a quick joint 34 which will be described hereinafter. The paint cartridge 11 is loaded on the coating apparatus 2 through fitting engagement of the mount block 13 with the cartridge mounting portion 3C of the housing 3. At the paint replenishing unit 35, the mount block 13 of the paint cartridge 11 is brought into fitting engagement with a cartridge mounting portion (not shown) of a paint replenishing deck 37.

Indicated at 16 is a feed tube which is projected axially forward from the front side of the mount block 13. Formed internally of the feed tube 16 is a first paint passage 17 with a valve seat 16A in a fore end portion as will be described hereinafter. In this instance, through the feed tube 16, paint from the paint chamber 22 is supplied toward the rotary atomizing head 6 through the first paint passage 17, as described hereinafter. Besides, the feed tube 16 plays a role as a paint refilling port, permitting to refill paint into the paint chamber 22 by way of the feed tube 16.

Indicated at 17 is a first paint passage which is formed internally of the tank base 12 through the feed tube 16. That is to say, the first paint passage 17 is extended through both of the mount block 13 and the feed tube 16. At a rear end, the first paint passage 17 is opened to the bottom of the support member fitting hole 13C of the mount block 13 to communicate the paint chamber 22 with a fore end portion of the feed tube 16 through a second paint passage 23, which will be described hereinafter. Thus, the first paint passage 17 plays a role of circulating paint through into the feed tube 16.

Indicated at 18 is a paint valve which is provided in the mount block 13 and operative as a normally closed valve. This paint valve 18 is largely constituted by a piston 18A which is axially and slidably fitted in a valve member receptacle space 13D in the mount block 13, an elongated valve body 18B which is attached to the piston 18A at its base end and axially extended as far as a fore end of the feed tube 16 at its fore end to seat on and off the valve seat 16A, and a valve spring 18C which is adapted to bias the piston 18A in a direction toward a closed position of the valve body 18B.

Normally, the valve body 18B of the paint valve 18 is seated on the valve seat 16A under the influence of the biasing action of the valve spring 18C to block the first paint passage 17 in the feed tube 16. On the other hand, upon supply of a pilot air, the piston 18A is displaced against the action of the valve spring 18C, unseating the valve body 18B to open the first paint passage 17.

Now, description is directed to the baggy tank 19 which is detachably attached to the tank base 12.

Figure 6:
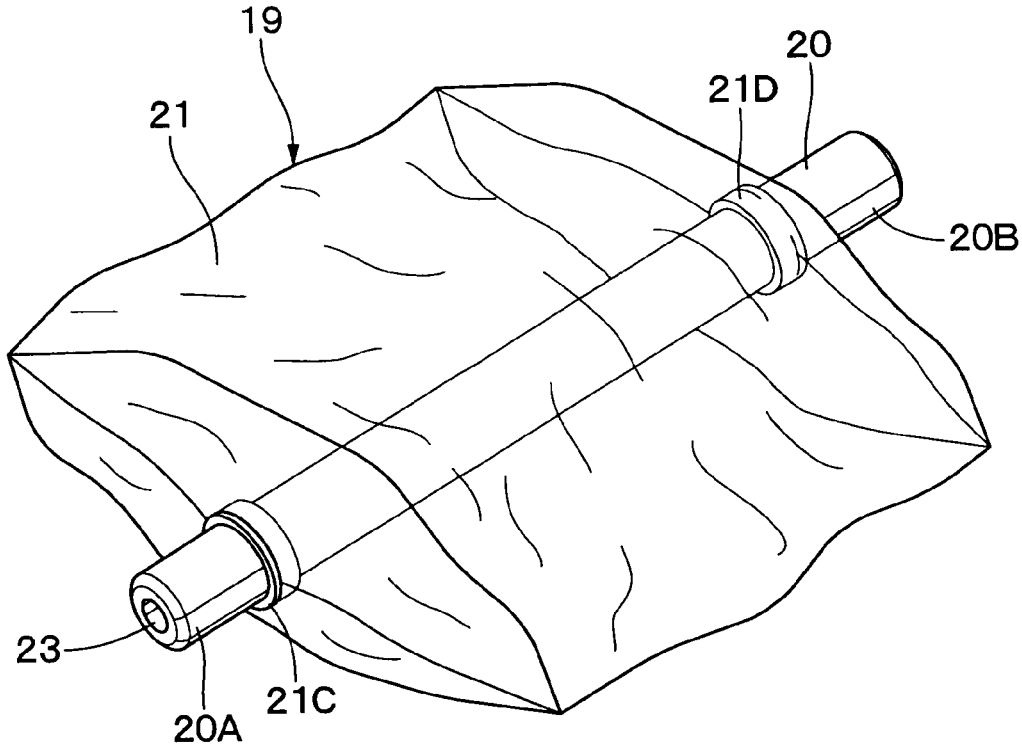
FIG. 6 is a schematic perspective view of a baggy tank showing on an enlarged scale.

As shown in FIGS. 4 and 6, the baggy tank 19 is largely constituted by a centrally located support member 20, a bag member 21 which is fitted around the outer periphery of the support member 20, a paint chamber 22 defined internally of the bag member 21, a second paint passage 23 formed in a front end portion of the support member 20, and a leakage liquid discharge passage 24 formed in a rear end portion of the support member 20. In this instance, the baggy tank 19 is extremely simple in construction and can be formed to be attached the bag member 21 around the outer periphery of the support member 20. At the time of replacement, a baggy tank 19 can be easily put into or out of a lid detachable opening 26D of a cylindrical cover 26, which will be described hereinafter.

Figure 7:
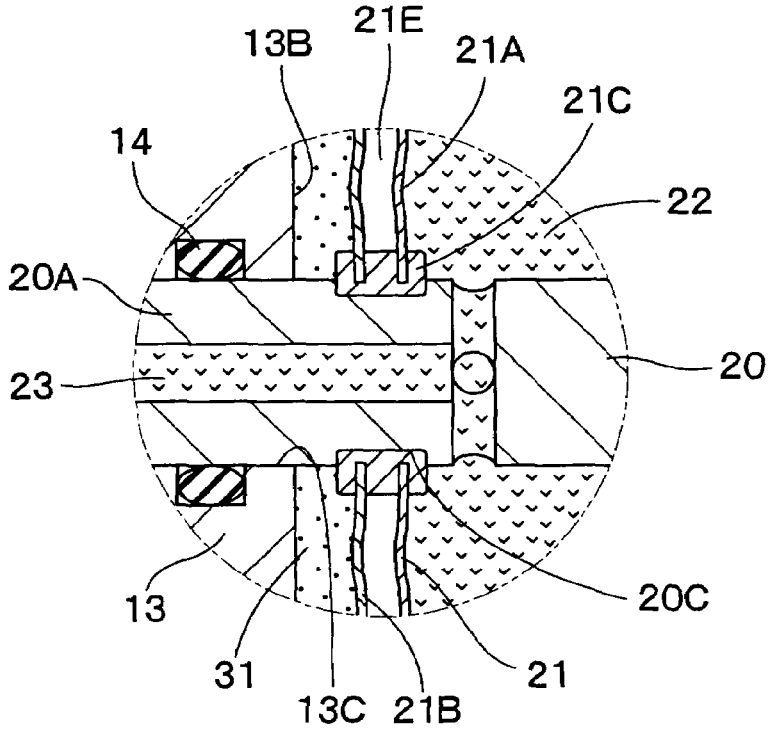
FIG. 7 is an enlarged sectional view of a front end portion of the baggy tank and a second paint passage showing on an enlarged scale.

Indicated at 20 is a support member of the baggy tank 19. More specifically, the support member 20 is formed in the shape of an elongated slender column, which is extendable in forward and rearward direction. A fore end portion 20A of the support member 20 is detachably fitted in the support member fitting hole 13C on the mount block 13 which constitutes the tank base 12, while its rear end portion 20B is detachably fitted in a support member fitting hole 27B in a lid portion 27 which constitutes a tank accommodating unit 25, which will be described hereinafter. Further, as shown in FIG. 7, an fitting groove 20C is formed around the outer periphery of a fore end portion of the support member 20 for fitting engagement with a fore fixing ring 21C of a bag member 21, which will be described hereinafter. On the other hand, as shown in FIG. 8, a similar fitting groove 20D is formed around the outer periphery of a rear end portion of the support member 20 for fitting engagement with a rear fixing ring 21D of the bag member 21.

Indicated at 21 is a bag member which is fitted on the outer periphery of the support member 20. This bag member 21 is formed as a dual bag structure composed of an inner bag 21A and an outer bag 21B which is wrapped around the inner bag 21A. The inner and outer bags 21A and 21B are formed of a flexible film or membrane of a synthetic resin material with satisfactory properties in chemical resistance, particularly in resistance to paint and extruding liquid, as well as in flexibility staying damage-free even after repeated flexures, more particularly, formed of a synthetic resin like polyethylene (PE) and nylon, more preferably, a synthetic resin such as low density polyethylene (LDPE) and a linearly chained low density polyethylene (LLDPE). In this instance, a transparent synthetic resin material is used for the bag member 21. Fore and rear ends of the bag member 21 are liquid-tightly fixed by means of bonding or welding to fore and rear fixing rings 21C and 21D, respectively.

Figure 8:
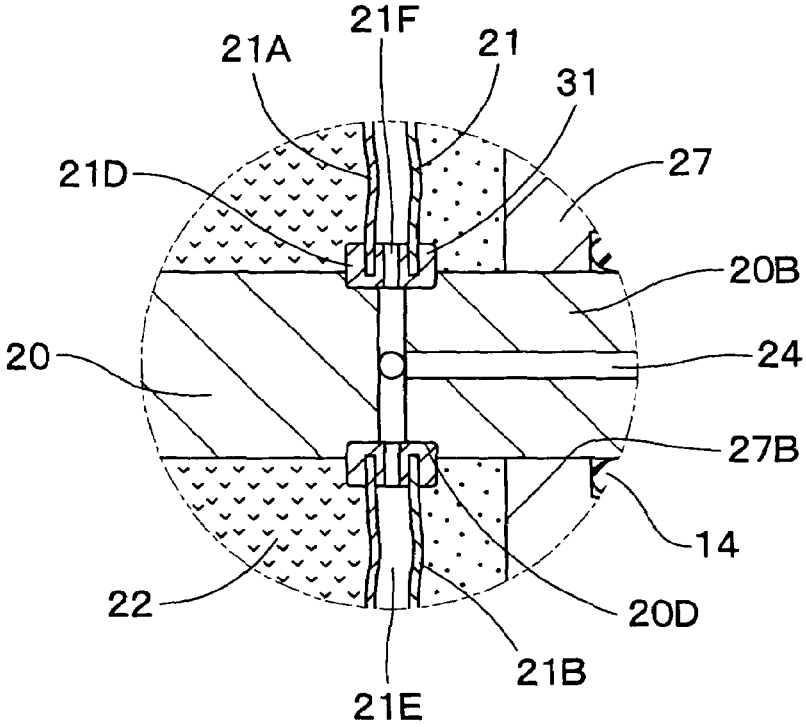
FIG. 8 is an enlarged sectional view of a rear end portion of the baggy tank and a leakage liquid discharge passage showing on an enlarged scale.

Further, as shown in FIGS. 7 and 8, the inner and outer bags 21A and 21B are fixed to the fore and rear fixing rings 21C and 21D with axially spaced positions in forward and rearward directions in such a way as to leave a gap space 21E between the inner and outer bags 21A and 21B. This gap space 21E serves as a discharge passage for a leakage liquid like paint or extruding liquid which will leak out in case either the inner bag 21A or the outer bag 21B is ruptured. Further, a leaked paint or an extruding liquid between the inner and outer bags 21A and 21B is urged to flow out through a communication passage hole 21F which is formed in the rear fixing ring 21D in communication with a leakage liquid discharge passage 24, which will be described hereinafter. Normally, the gap space 21E between the paint and the extruding liquid is in a closed state. On the other hand, once paint or extruding liquid is leaked from the inner bag 21A or the outer bag 21B by breakage or damage, the gap space 21E is pushed open by the leaked paint or the extruding liquid to function as a leakage liquid discharge passage.

The bag member 21 is wrapped around the support member 20, with its fore and rear ends securely fixed in position by way of the fore and rear fixing rings 21C and 21D which are fitted liquid-tight into the fitting grooves 20C and 20D in fore and rear end portions of the support member 20, respectively. Thus, a paint chamber 22 is defined internally of the inner bag 21A, and the intervening gap space 21E is communicated with the leakage liquid discharge passage 24 through the communication passage hole 21F.

Indicated at 22 is a paint chamber which is defined internally by the inner bag 21A of the bag member 21. This paint chamber 22 accommodates a stock of paint to be supplied to the rotary atomizing head 6. In this instance, arrangements are made such that the paint chamber 22 (the inner bag 21) has a larger volumetric capacity as compared with an inner volume which is defined internally of the tank accommodating case 25 when attached to the mount block 13 of the tank base 12, i.e., as compared with the inner volume of an extruding liquid chamber 31 which will be described hereinafter. Accordingly, if an excessively large amount of paint is erroneously charged into the paint chamber 22, the bag member 21 is brought into abutting engagement with bottom surfaces 13B of the mount block 13 and inner surfaces of the tank accommodating case 25 before a large overcharging load is imposed on the bag member 21 itself, thus protecting the bag member 21 from damages which might result from overcharging of paint.

Indicated at 23 is a second paint passage which is formed in a fore end of the support member 20. A rear end of the second paint passage 23 is opened to the paint chamber 22, while a fore end of that is opened to a fore end portion of the support member 20. Thus, the second paint passage 23 brings the paint chamber 22 into communication with the first paint passage 17 provided in the tank base 12 in the state of that the fore end portion 20A of the support member 20 is fitted in the support member fitting hole 13C of the mount block 13.

Denoted at 24 is a leakage liquid discharge passage which is formed in a rear end portion of the support member 20. One end of this leakage liquid discharge passage 24 is communicated through the communication passage hole 21F with the gap space 21E in the bag member 21, while the other end is opened at the rear end of the support member 20. When a rear end portion 20B of the support member 20 is fitted in a support member fitting hole 27B of a lid portion 27, which will be described hereinafter, the leakage liquid discharge passage 24 brings the gap space 21E into communication with the outside (the ambient atmosphere) through a communication passage 27C in the lid portion 27.

Thus, in case paint in the inner bag 21A of the bag member 21 leaks into the gap space 21E through a punctured portion of the inner bag 21A, the leaked paint is discharged to the outside through the leakage liquid discharge passage 24 as a sign of a puncture in the inner bag 21A. Similarly, in case of a puncture in the outer bag 21B, the leaked extruding liquid is discharged to the outside through the leakage liquid discharge passage 24 as a sign of a puncture in the outer bag 21B.

Now, description is directed to the tank accommodating case 25 which is detachably attached to the mount block 13 of the tank base 12.

The tank accommodating case 25 is formed in the shape of a lidded tubular case which is closed on the rear side to accommodate the baggy tank 19. Namely, the tank accommodating case 25 is largely constituted by a cylindrical cover 26, a lid portion 27 and a retainer ring 29, which will be described hereinafter.

Indicated at 26 is a cylindrical cover which constitutes a main body of the tank accommodating case 25. This cylindrical cover 26 is so shaped as to form a space of a predetermined volume around the baggy tank 19. In order to make the baggy tank 19 visible from outside for inspection purposes, the cylindrical cover 26 is formed of a transparent or semi-transparent synthetic resin material such as, for example, acrylic resin, vinyl chloride resin, polyester resin and the like, by injection molding. Further, the cylindrical cover 26 is largely constituted by a rimmed or lipped open end portion 26A which is extended in diameter at the fore side, a rounded bottom portion 26B which is reduced in diameter to be closed in a rearward direction and a screwed projection 26C which is projected rearward from the rounded bottom portion 26B and tapped with a male screw on and around its outer periphery. Formed on the inner peripheral side of the screwed projection 26C is a lid detachable opening 26D having reduced diameter, which is closed with a detachable lid portion 27 which will be described hereinafter. The lid detachable opening 26D is uncovered when placing a baggy tank 19 into or out of the cylindrical cover 26.

Indicated at 27 is a lid portion which is detachably attached to a rear end portion of the cylindrical cover 26. The lid portion 27 is formed in the shape of a stepped cylinder, i.e., a shape complementary to the lid detachable opening 26D of the cylindrical cover 26. Rear side of the lid portion 27 is formed into a grip 27A to be gripped by a cartridge handler when transferring the paint cartridge 11. Further, as shown in FIG. 4, a support member fitting hole 27B is formed centrally into the front side of the lid portion 27 for fitting engagement with a rear end portion 20B of the support member 20 of the baggy tank 19. Furthermore, a communication passage 27C is formed axially through the lid portion 27 thereby to communicate the leakage liquid discharge passage 24 of the support member 20 with the outside.

Afore-mentioned seal member 14 is also fitted in the support member fitting hole 27B thereby to maintain a liquid-tight seal around the support member 20 of the baggy tank 19. Further, a seal member 28 is fitted on the circumference of the lid portion 27 thereby to form a liquid tight seal around the lid detachable opening 26D of the cylindrical cover 26. The lid portion 27 fitted in the lid detachable opening 26D of the cylindrical cover 26 is detachably fixed in position by the use of a retainer ring 29 which is threaded onto the screwed projection 26C.

The baggy tank 19 is set in the tank accommodating case 25 in the manner as follows. In the first place, the open end portion 26A of the cylindrical cover 26 is fitted into the screwed projection 13A on the mount block 13 of the tank base 12 and then fixedly fastened to the retainer ring 30 by threading onto the screwed projection 13A. At this time, a rear end portion 20B of the support member 20 of the baggy tank 19 is fitted in the support member fitting hole 27B in the lid portion 27 to grip the baggy tank 19 fixedly with the mount block 13.

Denoted at 30 is a retainer ring for detachably attaching the tank accommodating case 25 to the tank base 12. A female screw is tapped on the inner periphery of this retainer ring 30. In engagement with the outer periphery of the open end portion 26A of the cylindrical cover 26, this retainer ring 30 is threaded onto the male screw of the screwed projection 13A on the mount block 13 to fix the tank accommodating case 25 to the tank base 12.

Now, description is directed to an extruding liquid chamber 31 which is provided between the cylindrical cover 26 and the tank base 12.

As shown in FIG. 3, the extruding liquid chamber 31 is defined by the outer bag 21B of the bag member 21 of the baggy tank 19, inner surfaces of the cylindrical cover 26 of the tank accommodating case 25 and bottom surface 13B of the mount block 13, when the baggy tank 19 is set in the tank accommodating case 25 which is attached to the mount block 13 of the tank base 12. An extruding liquid is supplied to and from this extruding liquid chamber 31 to push out paint in the paint chamber 22 through the bag member 21.

Further, a cartridge side extruding liquid passage 32 provided on the tank base 12 along with an extruding liquid guide groove 33 and a quick joint 34 is constructed, in the manner as follows.

Indicated at 32 is an extruding liquid passage on the side of the cartridge, which is formed into the mount block 13 of the tank base 12. In order to connect the extruding liquid chamber 31 either to the housing side extruding liquid passage 9 or to a replenishing stand side extruding liquid passage (not shown), one end of the extruding liquid passage 32 is opened in the bottom surface 13B of the mount block 13 while the other end is opened to a joint installation cavity 13E.

Indicated at 33 is an extruding liquid guide groove which is formed in the bottom surface of the mount block 13. This extruding liquid guide groove 33 is formed in an annular shape at a coinciding position relative to the extruding liquid passage 32 for communication therewith. The extruding liquid guide groove 33 prevents the extruding liquid passage 32 from being blocked by the bag member 21 when the extruding liquid in the extruding liquid chamber 31 is pushed out through the extruding liquid passage 32 and discharged by the pressure of paint being replenished into the paint chamber 22, precluding a replenishment failure which might be caused by blockage of the extruding liquid passage 32. Instead of an annular shape as just described above, the extruding liquid guide groove 33 may be formed in, for example, a semi-circular, linear or other shape as long as it can prevent blockage of the extruding liquid passage 32.

Indicated at 34 is a quick joint with a check valve, which is mounted in the joint installation cavity 13E of the mount block 13. This quick joint 34 is constituted by a valve casing 34A, a valve body 34B displaceably accommodated in the valve casing 34A, a valve seat 34C to be seated and unseated by the valve body 34B, and a valve spring 34D adapted to bias the valve body 34B toward the valve seat 34C.

As shown in FIG. 2, the valve body 34B of the quick joint 34 is pushed open when the paint cartridge 11 is set in the housing 3 of the coating apparatus 2 or on a paint replenishing deck 37 at the paint replenishing unit 35. On the other hand, as soon as the paint cartridge 11 is removed from the housing 3 or a paint replenishing deck 37, the valve body 34B is closed by the action of the valve spring 34D as shown in FIG. 3, preventing the extruding liquid from flowing out through the extruding liquid passage 32 on the side of the cartridge.

Indicated at 35 is a paint replenishing unit with facilities for replenishment of a plural number of different paint colors to the paint cartridge 11, for example, from colors a, and b up to a color n. This paint replenishing unit 35 is located within an operative range of the coating robot 1, and provided with a plural number of paint replenishing deck 37 on a deck 36 for the respective paint colors available at this unit (see FIG. 1). Paint cartridges 11 are each releasably set on a paint replenishing deck 37 of a corresponding color.

Being arranged as described above, the paint coating system of the first embodiment is put in paint coating actions utilizing the paint cartridges 11 in the manner as follows.

In the first place, a paint cartridge 11 which is filled with paint in the paint chamber 22 is attached to a coating apparatus 2 in preparation for a paint coating operation. In this case, as shown in FIG. 2, the paint cartridge 11 is set in the cartridge mounting portion 3C on the housing 3. In the next place, in this state, the extruding liquid valve 10 and paint valve 18 are opened, introducing an extruding liquid into the extruding liquid chamber 31 through the extruding liquid passages 9 and 32, pressing the bag member 21 and contracting the paint chamber 22. As a result, paint in the paint chamber 22 is spurted out through the second and first paint passages 23, 17 from a fore distal end of the feed tube 16 toward the rotary atomizing head 6.

At this time, paint is charged with a high voltage which is applied by the high voltage generator 7. As a result, the paint which is spurted out from the feed tube 16 is atomized by the rotary atomizing head 6, and atomized paint particles are put on a flight along lines of electric force which are formed between the rotary atomizing head 6 and a work piece, and finally deposited on the work piece.

On the other hand, a paint cartridge 11 which has become empty of paint as a result of a coating operation is replenished in the manner as follows. For this purpose, an emptied paint cartridge 11 is detached from the cartridge mounting portion 3C on the housing 3, and set on a paint replenishing deck 37 of the paint replenishing unit 35. In this state, the paint valve 18 is opened to let paint from a paint source flow into the fore distal end of the feed tube 16 to refill paint into the paint chamber 22 through the paint passages 17 and 23.

The bag member 21 of the baggy tank 19 of the paint cartridge 11 can be damaged as a result of repeated paint charging and discharging. A puncture or breakage of the bag member 21 of the baggy tank 19 is detected and coped with in the manner as follow.

In the event of breakage of the inner bag 21A which defines the paint chamber 22 internally of the bag member 21, paint in the paint chamber 22 leaks through a ruptured portion of the inner bag 21A into the gap space 21E. Leaked paint flows through the gap space 21E and then through the leakage liquid discharge passage 24 of the support member 20, and comes out through the communication passage 27C in the lid portion 27. Thus, the paint which flows out through the intercommunication passage 27C of the lid portion 27 is a sign that the inner bag 21A of the bag member 21 has been ruptured, making it possible for an operator to cope with the rupture quickly to minimize losses.

On the other hand, in the event of breakage of the outer bag 21B of the bag member 21, the extruding liquid in the extruding liquid chamber 31 leaks out through a ruptured portion of the outer bag 21B and comes to the outside after flowing through the gap space 21E, leakage liquid discharge passage 24 and communication passage 27C, giving a visible sign that the outer bag 21B of the bag member 21 has been ruptured.

In the event of breakage of the bag member 21, it is necessary to replace the baggy tank 19 according to a tank replacing operation as described below.

In the first place, the retainer ring 29 is loosened and removed to extract the lid portion 27 from the screwed projection 26C of the cylindrical cover 26. As a result, a rear end portion 20B of the support member 20 of the baggy tank 19 is exposed to the outside through the lid detachable opening 26D within the screwed projection 26C. Therefore, by gripping and extending the exposed rear end portion 20B of the support member 20, the damaged baggy tank 19 alone can be easily pulled out of the lid detachable opening 26D of the cylindrical cover 26.

After removing the damaged baggy tank 19, a fresh baggy tank 19 is put into the cylindrical cover 26 through the lid detachable opening 26D until a fore end portion 20A of a support member 20 is fully placed in the support member fitting hole 13C on the mount block 13 which constitutes the tank base 12. Thereafter, the lid portion 27 is placed in the screwed projection 26C of the cylindrical cover 26, receiving a rear end portion 20B of the support member 20 in the support member fitting hole 27B. In this state, the retainer ring 29 is threaded onto the screwed projection 26C as a last step of a tank replacing operation, i.e, replacing an emptied baggy tank with a refilled one 19.

Thus, the paint cartridge 11 according to the first embodiment of the invention employs the baggy tank 19 which is built of the elongated axially extending support member 20 which is extended in a forward and rearward direction, the bag member 21 having opposite ends thereof fixed liquid-tight on the circumference of the support member 20, the paint chamber 22 defined internally of the bag member 21, and the second paint passage 23 provided in a front end portion of the support member 20 to communicate the paint chamber 22 with the first paint passage 17.

Thus, each baggy tank 19, which is used disposably and needs to be replaced on a periodical basis, is built in a simplified construction, which is composed of a rodlike support member 20 and a bag member 21 and can be fabricated at a reduced cost. That is to say, it becomes possible to cut down the initial cost for fabrication of the paint cartridge 11 as well as the running cost which would incur for periodical replacements of the baggy tank 19, helping to lessen the burdens in cost on the part of the machine users.

Besides, when assembled into the paint cartridge 11, the support member 20 of the baggy tank 19 is fixedly gripped and mounted between the mount block 13 of the tank base 12 and the lid portion 27 of the tank accommodating case 25. Therefore, the baggy tank 19 can be removed and replaced by a fresh one quickly in a facilitated manner without using any tool in detaching the lid portion 27 from the tank accommodating case 25, which increases the efficiency of the replacing operation. The baggy tank 19 can also be replaced by detaching the tank accommodating case 25 from the tank base 12.

The paint cartridge 11 which has the paint chamber 22 in the inner bag member 21 of the baggy tank 19 can dispense paint without using a sliding piston as in Japanese Patent Laid-Open No. H11-262699 mentioned hereinbefore in connection with the prior art. That is to say, both of the support member 20 of the baggy tank 19 and the cylindrical cover 26 of the tank accommodating case 25 do not require almost all of the precision machining in particular in a finishing stage and can be fabricated easily by injection molding.

Further, the paint chamber 22 in the bag member 21 (in the inner bag 21A) of the baggy tank 19 is arranged to have a larger inner volume as compared with the inner volume of the tank accommodating case 25, defined by the mount block 13 of the tank base 12 and the tank accommodating case 25, i.e., a maximum inner volume of the extruding liquid chamber 31. Therefore, in case an excessively large amount of paint is charged into the paint chamber 22, the bag member 21 is brought into abutting engagement with inner surfaces of the mount block 13 of the tank base 12 and tank accommodating case 25 before it is inflated to an excessive degree, and allowed to rest against inner surfaces of the tank accommodating case 25 with almost free of overcharging loads. That is to say, the bag member 21 can enjoy a longer service life. Besides, the inner and outer bags 21A and 21B of the bag member 21 are exempted from overcharging loads, therefore these inner and outer bags can be fabricated by the use of a material which is generally available at a low cost.

On the other hand, the cylindrical cover 26 of the tank accommodating case 25 is formed of a transparent or semi-transparent synthetic resin material, so that the baggy tank 19 is visible from outside and can be checked easily by an eye inspection. Besides, in the event of breakage of the bag member 21 of the baggy tank 19, one can spot it from outside in an early stage to minimize losses which might be incurred.

Further, the bag member 21 of the baggy tank 19 is of a dual bag structure which is composed of the inner and outer bags 21A and 21B which are intervened by a gap space 21E. In addition, the leakage liquid discharge passage 24 is formed in the support member 20 to communicate the gap space 21E with the outside atmosphere through the communication passage 27C in the lid portion 27. Therefore, in case the inner bag 21A of the bag member 21 is ruptured and paint is leaked out of the inner bag 21A, the leaked paint can be discharged to the outside from the gap space 21E between the inner bag 21A and the outer bag 21B through the leakage liquid discharge passage 24 and communication passage 27C, as an alarming sign for breakage of the inner bag 21A. Thus, one can spot the breakage of the inner bag 21A in an early stage. On the other hand, in the event of breakage of the outer bag 21B of the bag member 21, the extruding liquid which has leaked from the outer bag 21B is discharged to the outside atmosphere from the gap space 21E through the leakage liquid discharge passage 24 and the communication passage 27C, as an alarming sign for breakage of the outer bag 21B. Thus, from the discharged extruding liquid, one can detect the breakage of the outer bag 21B in an early stage even if the breakage is an extremely small one, and can cope with the matter soon to minimize losses which might be incurred.

Furthermore, the extruding liquid guide groove 33 which is extended annularly is formed into the bottom surface 13B of the mount block 13 of the tank base 12 in communication with the extruding liquid passage 32 on the side of the cartridge 11. This extruding liquid guide groove 33 is provided to preclude the possibilities of the extruding liquid passage 32 being covered and blocked by the bag member 21 when an extruding liquid is discharged from the extruding liquid chamber 31 through the extruding liquid passage as a result of paint replenishment into the paint chamber 22. In the present embodiment, thanks to the provision of the extruding liquid guide groove 33, communication between the extruding liquid chamber 31 and the extruding liquid passage 32 can be maintained all the time with free of possibilities of blockage by the bag member 21, thus preventing deficient paint replenishment into the paint chamber 22 in a reliable manner.

Further, a retainer ring 30 is provided on the outer surface of the open end portion 26A of the tank accommodating case 25, and the tank accommodating case 25 is fixedly fastened to the mount block 13 of the tank base 12 by threading the retainer ring 30 on the screwed projection 13A which is mounted on the mount block 13 of the tank base 12. Therefore, at the time of maintenance or repair operations of the paint cartridge 11, the tank accommodating case 25 can be attached or detached to or from the tank base 12 easily and simply by turning the retainer ring 30 with fingers, namely, without using any tool.

Furthermore, the baggy tank 19 can be used repeatedly without dismantling same from the paint cartridge 11. That is to say, the paint cartridge 11 can contribute to enhance efficiency of coating operations because, after paint replenishment, it is ready for use in a next coating operation. Besides, since the baggy tank 19 is accommodated internally of the paint cartridge 11, there is no possibility of paint deposition on the housing 3 even when paint is leaked out as a result of breakage of the baggy tank 19.

Figure 9:
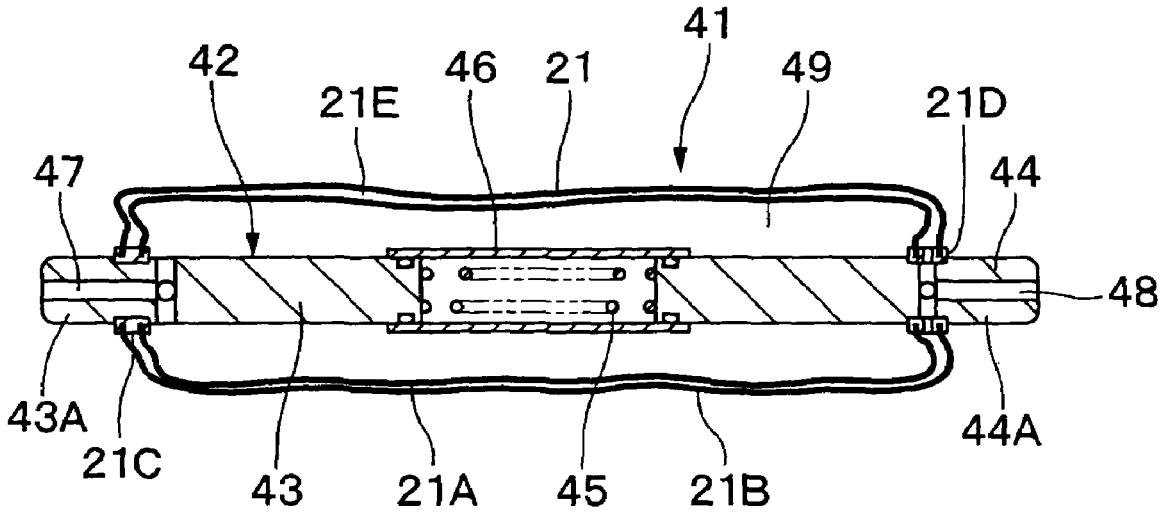
FIG. 9 is a longitudinal sectional view of a baggy tank alone, according to a second embodiment of the invention.

Now, turning to FIG. 9, there is shown a second embodiment of the present invention. This embodiment has a feature that a support member of a baggy tank is formed of a plural number of telescopically connected parts in a longitudinal direction. In the following description of the second embodiment, those component parts which are identical with a counterpart in the foregoing first embodiment are simply designated by the same reference numerals or characters to avoid repetitions of similar descriptions.

In FIG. 9, indicated at 41 is a baggy tank and at 42 is a support member of the baggy tank 41, which are adopted in the second embodiment. The support member 42 of the baggy tank 41 is built in a telescopic structure which is expansible in its longitudinal direction. Namely, the support member 42 of this embodiment is composed of a front rod 43, a rear rod 44 which is disposed coaxially with some space relative to the front rod 43, a compression spring 45 interposed between the front and rear rod 43 and 44, and a cover member 46 slidably fitted on the front and rear rod 43 and 44 in such a way as to enshroud the compression spring 45.

Further, a fore fixing ring 21C of a bag member 21 is fitted liquid-tight on a fore end portion 43A of the front rod 43, which is internally formed with a second paint passage 47. On the other hand, a rear fixing ring 21D of the bag member 21 is fitted liquid-tight on a rear end portion 44A of the rear rod 44, which is internally formed with a leakage liquid discharge passage 48. A paint chamber 49 is defined internally of the bag member 21 around the support member 42.

The baggy tank 41 is set in position by extractibly fitting the front and rear rod 43 and 44 of the support member 42 in a support member fitting hole 13C in a mount block 13 of a tank base 12 and in a support member fitting hole 27B in a lid portion 27 of a tank accommodating unit 25, respectively. By so fitting, the baggy tank 41 is gripped and mounted between the tank base 12 and the lid member 27 of the tank accommodating case 25.

When set in position, the front and rear rod 43 and 44 of the support member 42 are biased in a direction away from each other by the action of the compression spring 45 and as a result the fore end portion 43A of the front rod 43 and the rear end portion 44A of the rear rod 44 are pressed against bottoms of the support member fitting hole 13C in the mount block 13 and support member fitting hole 27B in the lid portion 27 of the tank accommodating case 25, respectively. In this case, the support member 42 can absorb dimensional errors on the part of the tank base 12 and the tank accommodating case 25, if any, and is connectible to the respective sockets in a liquid-tight state.

Being arranged as described above, the second embodiment can produce substantially the same operational effects as the foregoing first embodiment. Particularly in the second embodiment, the support member 42 of the baggy tank 41 is built of the telescopically expansible front and rear rod 43 and 44, compression spring 45 and cover member 46. Therefore, even if dimensional errors exist in the distance between the mount block 13 of the tank base 12 and the lid portion 27 of the tank accommodating case 25, the telescopic support member 42 is connectible liquid-tight to absorb dimensional errors, if any. Thus, the baggy tank 41 can be gripped stably between the tank base 12 and the tank accommodating case 25 with free of saccadic movements.

Figure 10:
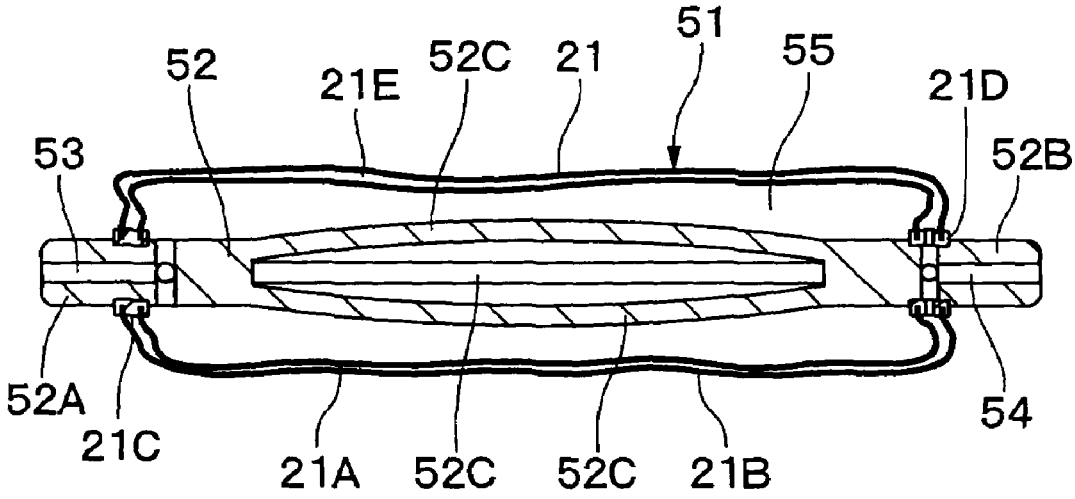
FIG. 10 is a longitudinal sectional view of a baggy tank alone, according to a third embodiment of the invention.

Now, turning to FIG. 10, there is shown a third embodiment of the invention. This embodiment has a feature in that a support member of a baggy tank is formed of a plural number of stringer members which is in the form of a split shafts at the intermediate portion. In the following description of the third embodiment, those component parts which are identical with a counterpart in the foregoing first embodiment are designated by the same reference numeral or character to avoid repetitions of similar descriptions.

In FIG. 10, indicated at 51 is a baggy tank according to the third embodiment and at 52 a support member of the baggy tank 51. This support member 52 is in the form of a split shaft having, between fore and rear end portions 52A and 52B, a plural number of curved stringer ribs 52C (by way of example, three of four stringer ribs 52C are shown in the drawing).

A fore fixing ring 21C of a bag member 21 is fixed liquid-tight on the fore end portion 52A of the support member 52, which is internally formed with a second paint passage 53. On the other hand, a rear fixing ring 21D of the bag member 21 is fixed liquid-tight on the rear end portion 52B of the support member 52, which is internally formed with a leakage liquid discharge passage 54. Further, a paint chamber 55 is defined internally of the bag member 21 around the support member 52.

The third embodiment, with the above-described arrangements, can produce substantially the same operational effects as the foregoing first embodiment. Especially in the third embodiment, the support member 52, having a longitudinally intermediate portion split into a plural number of stringer ribs 52C, can be reduced in weight to a considerable degree while guaranteeing sufficient strength.

Figure 11:
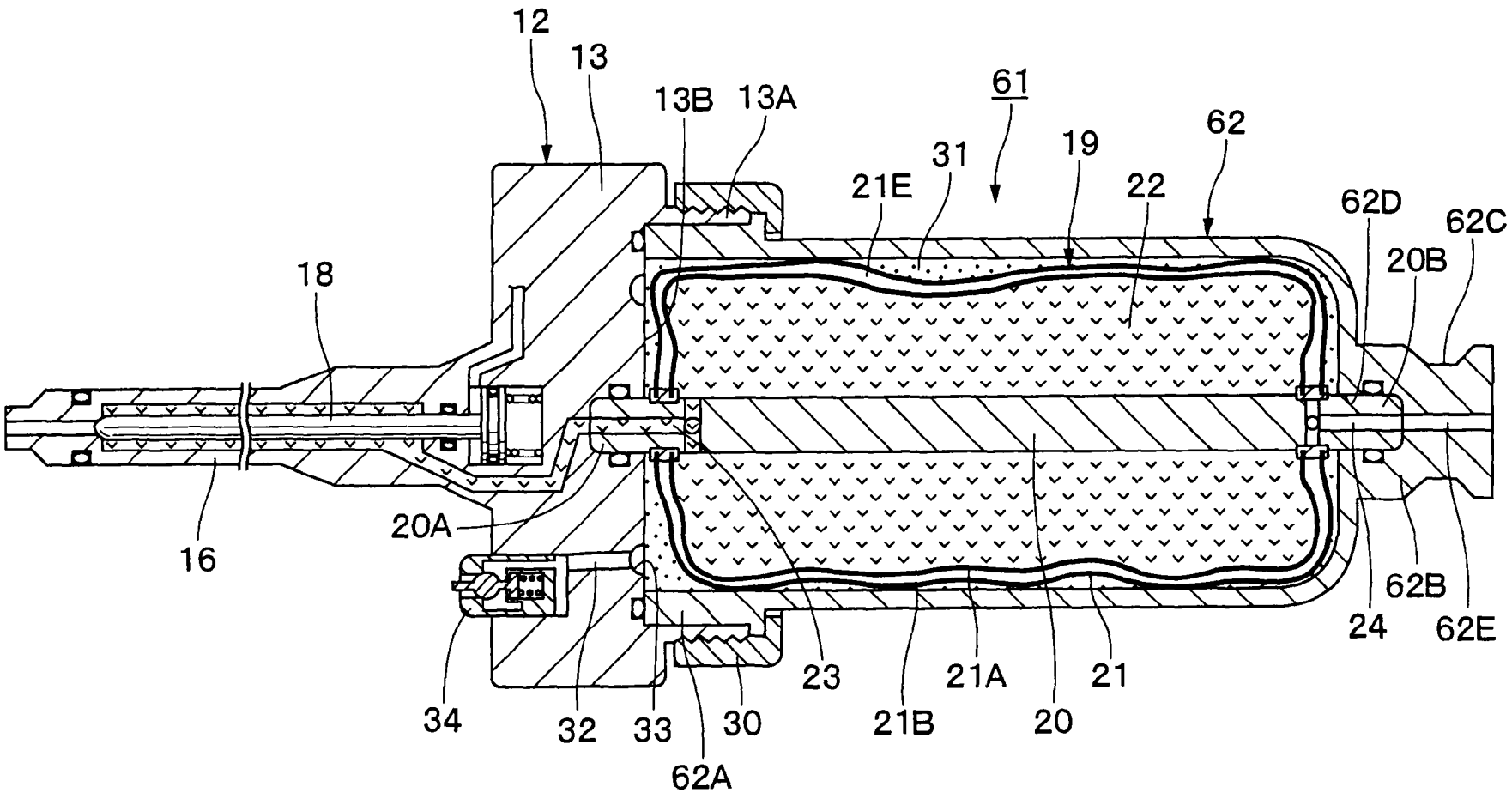
FIG. 11 is a longitudinal sectional view of a paint cartridge having a tank accommodating case according to a fourth embodiment of the invention.

Now, turning to FIG. 11, there is shown a fourth embodiment of the present invention. This fourth embodiment has a feature in that a tank accommodating case is formed by a single structural part. In the following description of the fourth embodiment, those component parts which are identical with a counterpart in the foregoing first embodiment are simply designated by the same reference numeral or character to avoid repetitions of similar explanations.

In FIG. 11, indicated at 61 is a paint cartridge according to the fourth embodiment, and at 62 a tank accommodating case of the paint cartridge 61. In this case, the tank accommodating case 62 is formed in the shape of a single lidded tubular case which is open on the front side and closed on the rear side. Namely, on the front side, the tank accommodating case 62 is provided with an open end portion 62A which is increased in outside diameter, and, on the rear side, it is closed with an integrally formed lid portion 62B. Rear end portion of the lid portion 62B is formed into the shape of a grip 62C to be gripped by a cartridge handler. On the other hand, a support member fitting hole 62D and an communication passage 62E are formed coaxially and internally at the center of the lid portion 62B.

The tank accommodating case 62 is fixedly attached to a tank base 12 by fitting the open end portion 62A in an annular screwed projection 13A on a mount block 13 of the tank base 12 and then threading and tightening a retainer ring 30 on the annular screwed projection 13A.

The fourth embodiment, with the above-described arrangements, can produce substantially the same operational effects as the foregoing first embodiment. Especially, in the fourth embodiment employing the tank accommodating case 62 which is formed as a single structural part, it becomes possible to attach and detach the tank accommodating case 62 to and from the tank base 12 in a more facilitated manner.

Figure 12:
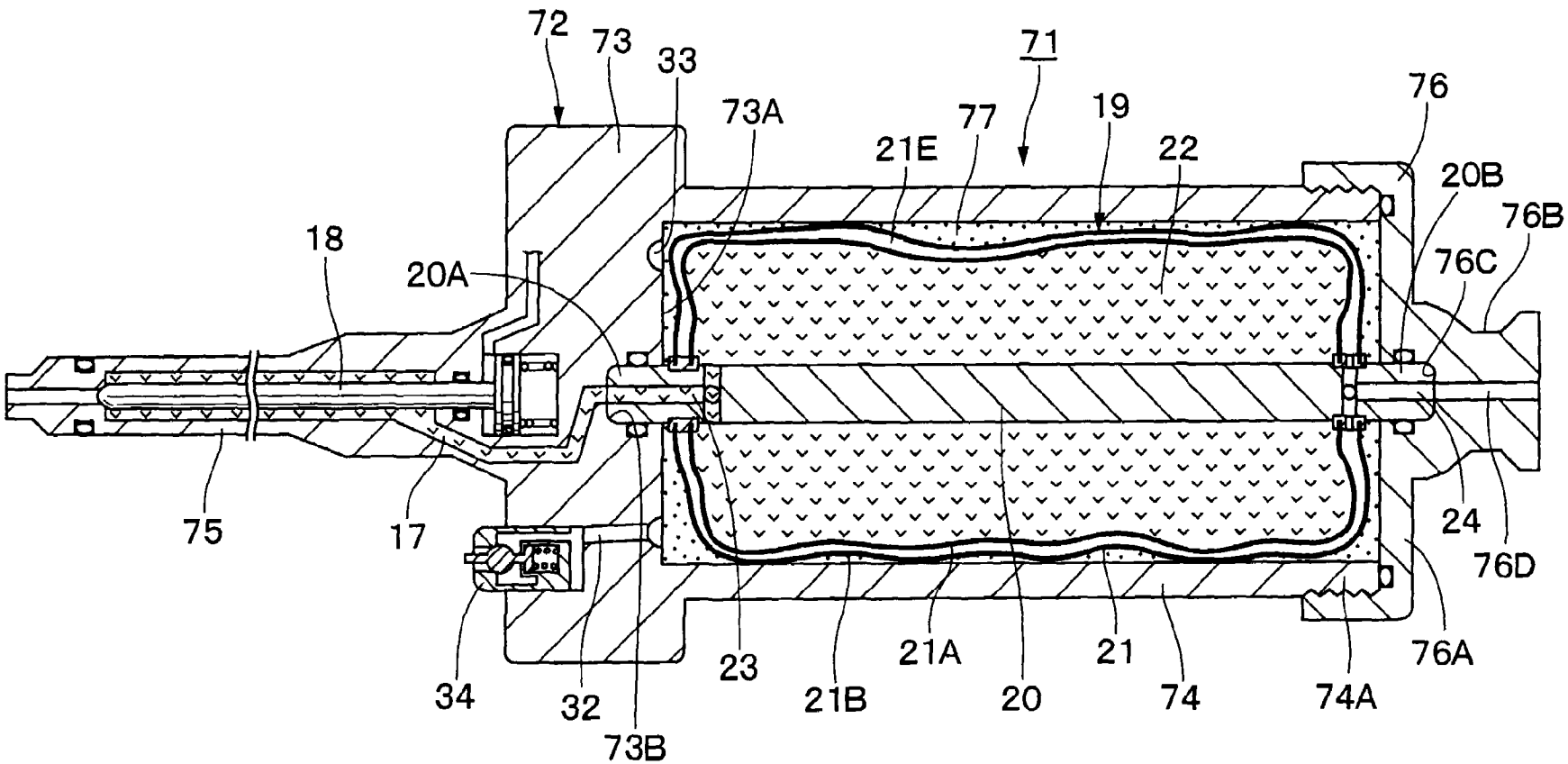
FIG. 12 is a longitudinal sectional view of a paint cartridge according to a fifth embodiment of the invention.

Now, turning to FIG. 12, there is shown a fifth embodiment of the present invention. This fifth embodiment has a feature in that a tank base, a mount block, a tank accommodating case and feed tube are integrated into one structural part, and a lid member is detachably attached to a rear end of the tank accommodating case. In the following description of the fifth embodiment, those component parts which are identical with a counterpart in the foregoing first embodiment are simply designated by the same reference numeral or character to avoid repetitions of similar descriptions.

In FIG. 12, indicated at 71 is a paint cartridge according to the fifth embodiment, and at 72 a tank base of the paint cartridge 71. In this case, the tank base 72 is constituted by a mount block 73 of a cylindrical shape or in the shape of a round disc to be set in a housing 3 of a coating apparatus 2, and formed integrally with a cylindrical tank accommodating case 74 which is extended rearward on the rear side of the mount block 73, and a feed tube 75 which is extended forward from the mount block 73. For fit-in engagement with a fore end portion 20A of a support member 20 of a baggy tank 19, a support member fitting hole 73B is formed centrally on a bottom surface 73A of the mount block 73. On the rear side, the tank accommodating case 74 is terminated with a lid detachable opening 74A and tapped with a male screw on and around the outer periphery of the lid detachable opening 74A.

The entire body of the tank base 72 or the tank accommodating case 74 is formed of a transparent or semi-transparent synthetic resin material. Therefore, in the same way as in the foregoing first embodiment, the baggy tank 19 can be inspected easily from outside through the transparent tank accommodating case 74.

Indicated at 76 is a lid member which is detachably attached on the tank accommodating case 74 of the tank base 72 to close the lid detachable opening 74A. The lid member 76 is comprised of a lid plate portion 76A threaded on the tank accommodating case 74 to close the lid detachable opening 74A, a grip portion 76B projected rearward from the center portion of the lid plate portion 76A, a support member fitting hole 76C formed centrally into the lid plate portion 76A, and a communication passage 76D formed to communicate the support member fitting hole 76C with the outside.

Thus, upon threading the lid member 76 onto the rear end of the tank accommodating case 74, the opposite ends of the support member 20 of the baggy tank 19 are securely gripped in the mount block 73 of the tank base 72 and the lid member 76. Further, upon closing the rear end of the tank accommodating case 74 with the lid member 76, an extruding liquid chamber 77 is defined between the baggy tank 19 and inner wall surfaces of the tank accommodating case 74.

In this instance, the bag member 21 of the baggy tank 19 is arranged to have a larger inner volume as compared with the inner volume of the extruding liquid chamber 77 which is defined by the mount block 73 of the tank base 72, tank accommodating case 74 and lid member 76. As a result, the extruding liquid chamber 77 is set to have a smaller inner volume as compared with the inner volume of the bag member 21. Therefore, in the same way as in the first embodiment described above, loads on the bag member 21 can be lessened to prevent damages to the bag member 21. Since the communication passage 76D is formed in the lid member 76, leaked paint or extruding liquid in the gap space 21E in the bag member 21 can be discharged to the outside through the leakage liquid discharge passage 24 and the communication passage 76D as an alarming sign for breakage of the bag member 21.

The fifth embodiment, with the above-described arrangements, can produce substantially the same operational effects as the foregoing first embodiment. Particularly in the fifth embodiment having the tank accommodating case 74 formed as an integral part of the tank base 72, the paint cartridge 11 can be built of a reduced number of parts, that is to say, can be assembled more efficiently.

Figure 13:
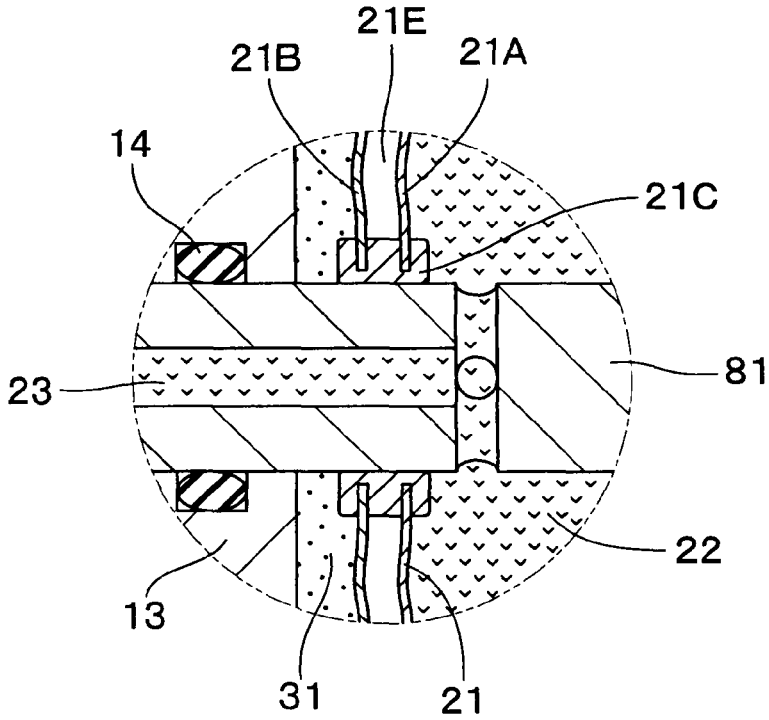
FIG. 13 is an enlarged sectional view of a first modification of the invention, taken from the same position as FIG. 7.

In the above-described first embodiment, by way of example the fore and rear fixing rings 21C and 21D of the bag member 21 are fitted liquid-tight in the ring fitting grooves 20C and 20D which are formed on fore and rear end portions of the support member 20. However, needless to say, the present invention is not limited to the particular example shown. For instance, as in a first modification shown in FIG. 13, a fore fixing ring 21C of a bag member 21 may be fixed liquid-tight on a non-grooved circumferential surface of a support member 81 by the use of an adhesive agent or the like. The same arrangements can be applied similarly to the fixing ring at the rear end of the support member 81, or to fixing rings in other embodiments of the invention.

Figure 14:
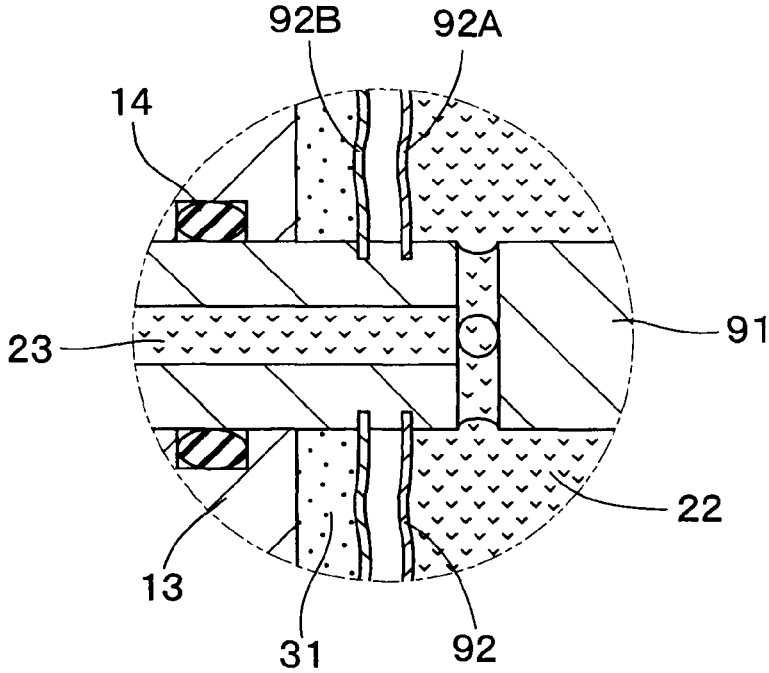
FIG. 14 is an enlarged sectional view of a second modification of the invention, taken from the position as FIG. 7.

Alternatively, as in a second modification shown in FIG. 14, arrangements may be made such that fore marginal edges of inner and outer bags 92A and 92B of a bag member 92 are directly gripped in a fore end portion of a support member 91. If desired, the same arrangements may be applied to a rear end of the support member 91 and the bag member 92, or to bag members in other embodiments of the invention.

Further, in the first embodiment described above, by way of example the bag member 21 of a dual bag structure which consists of the inner and outer bags 21A and 21B is employed for the baggy tank 19. However, the present invention is not limited to the particular example shown. For instance, if desired, the bag member may be made of a single synthetic resin film. The same modification is also applicable to other embodiments of the invention.

On the other hand, in the foregoing first embodiment, by way of example the cylindrical cover 26 of the tank accommodating case 25 is fixed to the mount block 13 of the tank base 12 by the use of the retainer ring 30. However, the present invention is not limited to this particular example. For instance, the cylindrical cover may be fixedly assembled with the mount block by directly threading an open end portion of the cylindrical cover onto the screwed projection on the mount block of the tank base. This modification is also applicable to other embodiments of the invention.

Further, in the above-described first embodiment, by way of example the leakage liquid discharge passage 24 is provided in the support member 20 of the baggy tank 19 and communicated with the outside through the communication passage 27C which is provided in the lid portion 27 of the tank accommodating case 25. However, the present invention is not limited to this particular example. For instance, the leakage liquid discharge passage can be directly communicated with the outside by reducing the axial length of the lid member or by prolonging the support member in a rearward direction. This modification is also applicable to other embodiments of the invention.

The invention claimed is:

1. A paint cartridge, comprising:

a tank base composed of a mount block to be mounted on a coating apparatus, and a feed tube extended forward on a front side of said mount block;

a first paint passage formed internally of said tank base through said feed tube;

a baggy tank composed of a support member extended in forward and rearward directions, and a bag member formed of a flexible material and wrapped around said support member, said bag member having opposite ends thereof fixed liquid tight to said support member to define a paint chamber in said bag member;

a second paint passage formed internally of said support member of said baggy tank with a rear end thereof opened to said paint chamber, a fore end of said second paint passage being brought into communication with said first paint passage when said baggy tank is attached to said tank base;

a tank accommodating case in the form of a lidded tubular case having an open end portion on front side and being closed with a lid portion on rear side, said open end portion being detachably attached to said mount block in such a way as to grip opposite ends of said support member of said baggy tank between said mount block of said tank base and said lid portion;

an extruding liquid chamber defined between said baggy tank and said tank accommodating case when said baggy tank is placed in said tank accommodating case after attaching the latter to said mount block of said tank base; and an extruding liquid passage provided on said tank base to supply an extruding liquid to and from said extruding liquid chamber, wherein said bag member of said baggy tank is a dual bag structure composed of an inner bag and an outer bag intervened by a gap space, and a leakage liquid discharge passage is formed in said support member of said baggy tank to communicate said gap space with the outside through said lid portion of said tank accommodating case.

2. A paint cartridge as defined in claim 1, wherein said paint chamber of said baggy tank is arranged to have a larger volumetric capacity as compared with an inner volume of said tank accommodating case attached to said tank base.

3. A paint cartridge as defined in claim 1, wherein said tank accommodating case is formed of a transparent or semi-transparent synthetic resin material.

4. A paint cartridge as defined in claim 1, wherein a communication passage is formed in said lid portion of said tank accommodating case to communicate said leakage liquid discharge passage with the outside.

5. A paint cartridge as defined in claim 1, wherein said extruding liquid passage is opened in a bottom surface of said mount block of said tank base, and an extruding liquid guide groove is formed into said bottom surface in communication with said extruding liquid passage.

6. A paint cartridge as defined in claim 1, wherein said tank accommodating case is constituted by a cylindrical cover with said open end portion on front side and a lid detachable opening on rear side, and a lid portion detachably fitted to cover said lid detachable opening of said cylindrical cover.

7. A paint cartridge as defined in claim 1, wherein said tank accommodating case is formed in the shape of a single lidded tubular case having said open end portion at a fore end and a closed bottom at a rear end thereof.

8. A paint cartridge, as defined in claim 1 wherein a retainer ring is provided on the outer surface of said open end portion of said tank accommodating case and said tank accommodating case is fixedly fastened to said mount block of said tank base by threading said retainer ring on said mount block of said tank base.

9. A paint cartridge, comprising:

a tank base integrally formed of a mount block to be mounted on a coating apparatus, a tank accommodating case extended rearward from said mount block, and a feed tube extended forward on a front side of said mount block;

a first paint passage formed internally of said tank base through said feed tube;

a baggy tank composed of a support member extended in forward and rearward directions, and a bag member formed of a flexible material and wrapped around said support member, said bag member having opposite ends thereof fixed liquid tight to said support member to define a paint chamber in said bag member;

a second paint passage formed internally of said support member of said baggy tank with a rear end thereof opened to said paint chamber, a fore end of said second paint passage being brought into communication with said first paint passage when said baggy tank is attached to said tank base;

a lid member detachably attached to a rear end of said tank accommodating case of said tank base and adapted to grip opposite ends of said support member of said baggy tank in cooperation with said mount block of said tank base;

an extruding liquid chamber defined between said baggy tank and said tank accommodating case when said baggy tank is placed in said tank accommodating case after attaching the lid member to said tank accommodating case; and an extruding liquid passage provided on said tank base to supply an extruding liquid to and from said extruding liquid chamber, wherein said bag member of said baggy tank is a dual bag structure composed of an inner bag and an outer bag intervened by a gap space, and a leakage liquid discharge passage is formed in said support member of said baggy tank to communicate said gap space with the outside through said lid member of said tank accommodating case.

* * * * *